US007548717B2

(12) United States Patent
Tateishi et al.

(10) Patent No.: US 7,548,717 B2
(45) Date of Patent: Jun. 16, 2009

(54) FIXING APPARATUS

(75) Inventors: Yoshinobu Tateishi, Nara (JP); Hiroaki Hori, Kyoto (JP); Yoshiyuki Nagai, Yamatokoriyama (JP); Toshiya Mikita, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 407 days.

(21) Appl. No.: 11/420,052

(22) Filed: May 24, 2006

(65) Prior Publication Data

US 2006/0269333 A1 Nov. 30, 2006

(30) Foreign Application Priority Data

May 24, 2005 (JP) ..... 2005-151262

(51) Int. Cl.
*G03G 15/20* (2006.01)

(52) U.S. Cl. ..... 399/326; 399/327

(58) Field of Classification Search ..... 399/325, 399/326, 327
See application file for complete search history.

(56) References Cited

U.S. PATENT DOCUMENTS 5,327,203 A * 7/1994 Rasch et al. ..... 399/326
5,705,447 A 1/1998 Kubo ..... 442/334
6,580,893 B2 * 6/2003 Ishizuka ..... 399/325
6,778,803 B2 * 8/2004 Matsumoto ..... 399/327 X
6,804,488 B2 * 10/2004 Matsumoto ..... 399/327
6,944,419 B2 * 9/2005 Kawamoto et al. ..... 399/327

FOREIGN PATENT DOCUMENTS

JP 01-237583 9/1989
JP 2003-107952 4/2003
JP 2003-255745 9/2003

* cited by examiner

*Primary Examiner*—Sandra L Brase
(74) *Attorney, Agent, or Firm*—Renner, Otto, Boisselle & Sklar, LLP

(57) ABSTRACT

A fixing apparatus that fuses and firmly adheres an unfixed developer onto a recording medium includes a heating roller and a pressure roller; a belt-shaped cleaning member that is disposed so as to abut on the heating roller and cleans the surface of the heating roller, the cleaning member being impregnated with oil in advance; a feed roller that sends out the cleaning member; a wind-up roller that winds up the cleaning member having cleaned the heating roller; a press-contact roller disposed so as to press the cleaning member against the heating roller on which the cleaning member abuts; and an oil absorbing layer that is disposed on an outer circumferential surface of the press-contact roller and absorbs oil exudation out of the cleaning member.

9 Claims, 6 Drawing Sheets

FIXING APPARATUS

BACKGROUND OF THE INVENTION

1. Field of the Invention

The present invention relates to a fixing apparatus favorably for use in an electrophotographic image forming apparatus, and to an image forming apparatus having the same.

2. Description of the Related Art

In an image formation using an electrophotographic system, a photoreceptor charged with a uniform electric potential is exposed to light in accordance with image information so that an electrostatic latent image is formed. The formed electrostatic latent image is developed by a developer so as to be visualized. The visualized image is transferred on a recording paper or the like, and the transferred developer on the recording paper is made to be fixed so as to form a solid recording image.

The fixing apparatus used for such image formation, is generally composed of a heating roller and a pressure roller. The fixing apparatus has such a configuration that, in passing the recording paper on which the developer for forming a visualized image through a press-contact region (hereinafter referred to as a nip portion) of the heating roller and the pressure roller, which press-contact region is formed by pressing the pressure roller against the heating roller, unfixed developer is fused and fixed by heating of the heating roller and pressing of the pressure roller.

During a fixing operation in the fixing apparatus, there sometimes occurs a so-called hot offset that the developer fused on the nip portion of the both rollers is not all fixed on the recording paper, but a part of the developer is attached to a surface of the roller. For instance, the developer attached to the heating roller is transferred on a portion which should be properly a white base, on a recording paper on which the developer is to be subsequently fixed, with the result that an image defect is made to occur.

Moreover, on the pressure roller, the developer which has already fixed to a back surface of the conveyed recording paper, for instance as in a case of duplex print, is sometimes fused again by heat in passing through the nip portion and a part of the developer is transferred and attached to the pressure roller. The developer thus attached to the pressure roller may cause the image defect and further, may cause a soil of the back surface of the recording paper.

The image defect caused by the hot offset in the fixing apparatus sometimes remains, in a case of black-and-white print, mere defects such as a fog in a white base of the formed image, a soil on the back surface of the recording paper, or the like in a tolerable range. However, in a case of full-color print, since a developer having a color different from a prescribed one is transferred from the both rollers, there often occur practically intolerable defects.

As a related art for solving such a problem, there is an apparatus having roller cleaning units on the both rollers provided in a fixing apparatus (refer to Japanese Unexamined Patent Publication JP-A 2003-107952).

FIG. 5 is a schematic view showing a configuration of a roller cleaning unit 1 provided in a related art fixing apparatus. FIG. 5 illustrates the roller cleaning unit 1 provided on a heating roller 2 in the fixing apparatus.

The roller cleaning unit 1 comprises a feeding roller 4 for feeding a belt-shaped cleaning member 3 which has been previously rolled up, a winding roller 5 for taking up the cleaning member 3 fed from the feeding roller 4, and a press-contact roller 6 (also referred to as a web press-contact roller) provided between the feeding roller 4 and the winding roller 5 so as to press the cleaning member 3 on the heating roller 2.

The roller cleaning unit 1 presses the cleaning member 3 on the heating roller 2 which is rotated in an arrow sign 7 direction in a state where the winding roller 5, the feeding roller 4, and the press-contact roller 6 are made to be at rest without being rotated so that the heating roller 2 and the cleaning member 3 are made to be slidingly scrubbed with each other. By so doing, a developer 8*a* attached in a fused state to an outer circumferential surface of the heating roller 2 is removed and the removed developer 8*b* is accumulated, still in a substantially fused state, in a gap formed by the cleaning member 3 located between the press-contact roller 6 and the winding roller 5, and the surface of the heating roller 2.

When the developer 8*b* accumulated in the gap reaches a certain amount, the roller cleaning unit 1 causes the wind-up roller 5 to perform a wind-up operation in a direction of an arrow 9 and wind up the cleaning member 3 by a predetermined length, thereby removing the developer 8*b* from the surface of the heating roller 2 with the developer adhered to the cleaning member 3.

The cleaning member 3 used to clean the roller in this way is impregnated with oil such as silicone oil in advance, for the purpose of increasing the releasability of residual toner, which is a residual developer adhering to a fixing roller, and increasing the heat resistance of the cleaning member 3 itself. That is to say, through sliding contact of the cleaning member 3 and, for example, the heating roller 2, the oil impregnated into the cleaning member 3 is applied to the surface of the heating roller 2, whereby the releasability of the toner adhering to the surface of the heating roller 2 is increased, and the heat resistance of the cleaning member 3 itself at a fixing temperature raised up to about 200° C. is increased.

However, since fixing rollers formed by the heating roller 2 and a pressure roller are heated and warmed in order to fix a toner image, the cleaning member 3 disposed so as to contact the fixing roller is warmed by heat transmitted from the fixing roller, and such a phenomenon is caused by warming that the impregnated oil seeps and flows out onto the fixing roller. FIG. 6 is a view illustrating a state where the oil has seeped out of the cleaning member 3. There is a problem that the oil flowing out onto the fixing roller (the heating roller 2 in FIG. 6) forms an oil puddle 10 on the fixing roller, and scatters in the apparatus as the fixing roller rotates or evaporates by being heated by the fixing roller to adhere to every part in the apparatus, thereby causing contamination. Moreover, there is a problem that the oil penetrates into a recording sheet, which is a medium for recording a toner image, passing through between the fixing rollers, and soils the recording sheet, thereby changing the gloss thereof.

SUMMARY OF THE INVENTION

An object of the invention is to provide a fixing apparatus capable of preventing contamination of an inside of the apparatus and a recording medium with oil exudation out of a belt-shaped cleaning member and exhibiting excellent cleaning performance, when cleaning a fixing roller (a heating roller or a pressure roller) by press-contact of the cleaning member to the fixing roller, and an image forming apparatus equipped with the same.

The invention provides a fixing apparatus comprising:

fixing rollers composed of a pair of rotating bodies, that fuse an unfixed developer of an image which is formed on a recording medium and firmly adhere the unfixed developer onto the recording medium by passing the recording medium through a press-contact portion formed between the fixing rollers;

a cleaning member that is belt-shaped, wound up and impregnated with oil in advance, for cleaning a surface of the at least one of the fixing rollers by abutting against the at least one of the fixing rollers;

a press-contact roller disposed so that the cleaning member is pressed onto the at least one of the fixing rollers;

a feed-out roller for feeding the cleaning member that is belt-shaped and wound up in advance;

a wind-up roller for winding up the cleaning member fed by the feed-out roller and having cleaned the surface of the at least one of the fixing rollers; and an oil absorbing portion for absorbing oil exudation out of the cleaning member.

The invention provides a fixing roller cleaning unit provided in the fixing apparatus mentioned above, comprising:

a cleaning member that is belt-shaped, wound up and impregnated with oil in advance, for cleaning a surface of the at least one of the fixing rollers by abutting against the at least one of the fixing rollers;

a press-contact roller disposed so that the cleaning member is pressed onto the at least one of the fixing rollers;

a feed-out roller for feeding the cleaning member that is belt-shaped and wound up in advance;

a wind-up roller for winding up the cleaning member fed by the feed-out roller and having cleaned the surface of the at least one of the fixing rollers; and an oil absorbing portion for absorbing oil exudation out of the cleaning member.

According to the invention, a fixing apparatus comprises: a belt-shaped cleaning member impregnated with oil in advance, which is disposed so as to abut on at least one of fixing rollers of the fixing apparatus and cleans the surface of the at least one of the fixing rollers; a press-contact roller disposed so as to press the cleaning member against the at least one of the fixing rollers; a feed-out roller that sends out the cleaning member; a wind-up roller that winds up the cleaning member having been sent out from the feed-out roller and having cleaned the surface of the at least one of the fixing rollers; and moreover, an oil absorbing portion for absorbing oil exudation out of the cleaning member. Consequently, it is possible to absorb the oil exudation out of the cleaning member by the oil absorbing portion, so that it is possible to prevent that a puddle of the oil exudation is formed on the at least one of the fixing rollers. Accordingly, such a fixing apparatus is realized that prevents the oil exudation out of the cleaning member onto the at least one of the fixing rollers from contaminating the inside of the apparatus and a recording medium, and has excellent cleaning performance.

Further, in the invention, it is preferable that the oil absorbing portion is an oil absorbing layer disposed on an outer circumferential surface of the press-contact roller.

According to the invention, the oil absorbing portion is an oil absorbing layer disposed on an outer circumferential surface of the press-contact roller. By thus disposing the oil absorbing layer onto the surface of the press-contact roller disposed so as to contact the cleaning member, it becomes possible to absorb the oil exudation out of the cleaning member with a simple structure.

Furthermore, in the invention, it is preferable that the oil absorbing portion includes a first oil absorbing layer disposed on an outer circumferential surface of the press-contact roller, and an absorbing roller that is disposed so as to abut on the press-contact roller and has a second oil absorbing layer.

According to the invention, the oil absorbing portion includes a first oil absorbing layer disposed on an outer circumferential surface of the press-contact roller, and an absorbing roller that is disposed so as to abut on the press-contact roller and has a second oil absorbing layer. By thus disposing, as the oil absorbing portion, another absorbing roller having the second oil absorbing layer so as to abut on and back up the press-contact roller, in addition to the first oil absorbing layer disposed to the press-contact roller, it is possible to absorb the oil exudation out of the cleaning member by the first oil absorbing layer of the press-contact layer, and further absorb by the second oil absorbing layer of the absorbing roller via the oil absorbing layer of the press-contact roller. As a result, it is possible to increase the amount of oil absorption, and it is possible to decrease the frequency of replacement or maintenance of the oil absorbing portion.

Still further, in the invention, it is preferable that the oil absorbing layer includes an oil absorbing material that is absorbent of oil.

Still further, in the invention, it is preferable that the oil absorbing material is paper.

According to the invention, the oil absorbing layer includes an oil absorbing material which is absorbent of oil, and it is preferred that the oil absorbing material is paper. Since the oil-absorbency of paper is excellent and is easily available, and moreover, can be recycled and reused after being deoiled, paper is favorably used as the material of the oil absorbing layer and can realize cost reduction and decrease of environmental loads.

Still further, in the invention, it is preferable that the press-contact roller is made of a foamed material having heat resistance.

According to the invention, the press-contact roller is made of a foamed material having heat resistance, so that the press-contact roller can elastically deform with ease, and can form a nip portion having a sufficient length with a proper pressing force against the at least one of the fixing rollers even if the press-contact roller has the oil absorbing layer.

Further, the invention provides an image forming apparatus for forming a print image in electrophotographic system, comprising the fixing apparatus mentioned above.

According to the invention, an image forming apparatus is equipped with the fixing apparatus described above, so that such an image forming apparatus is realized that can perform image formation without forming a defective image by hot offset, and moreover, can prevent contamination of the inside of the apparatus and contamination of a recording medium by the oil.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
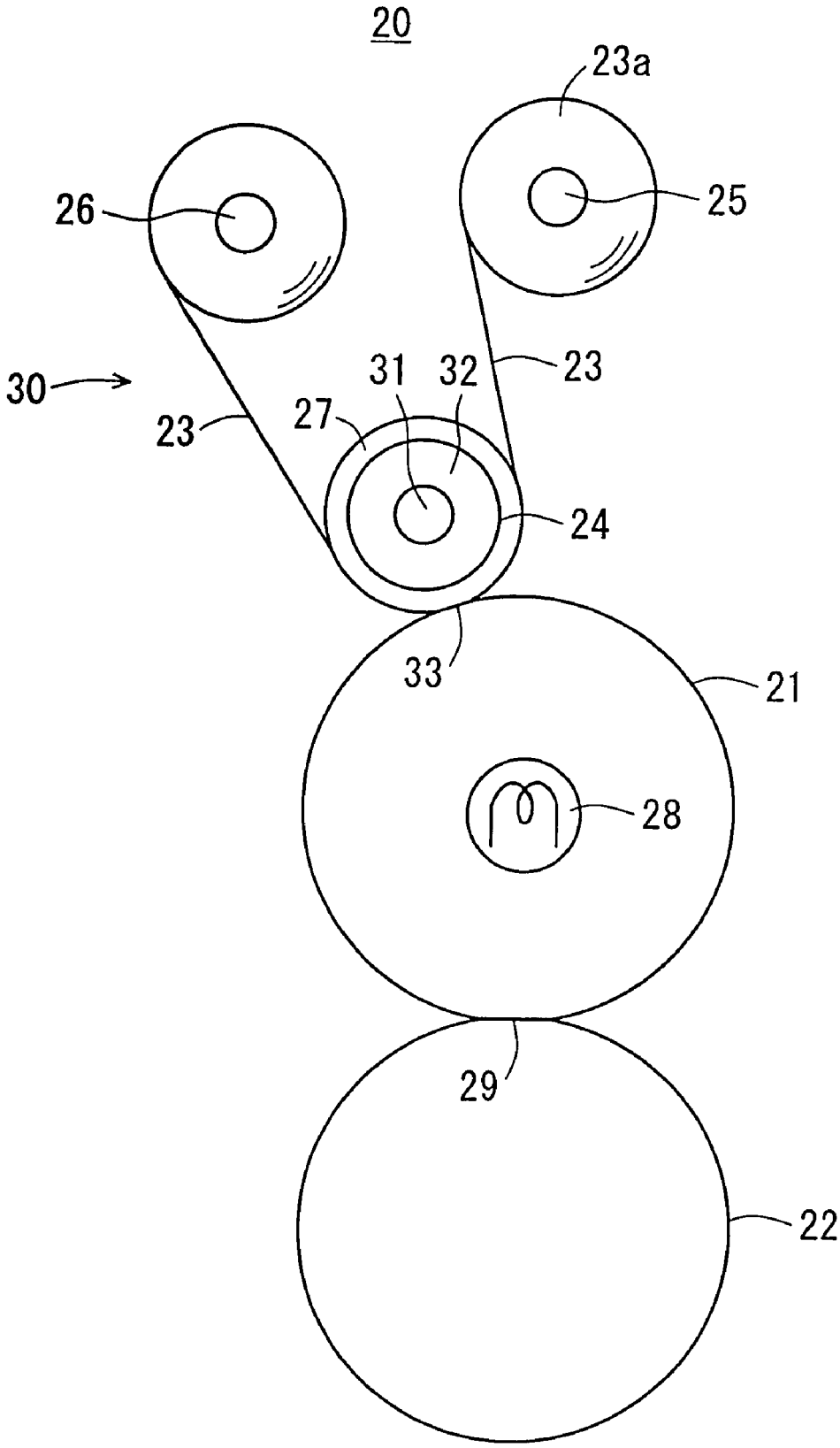
FIG. 1 is a simplified view illustrating a configuration of a fixing apparatus according to a first embodiment of the invention.

Now referring to the drawings, preferred embodiments of the invention are described below.

Figure 2:
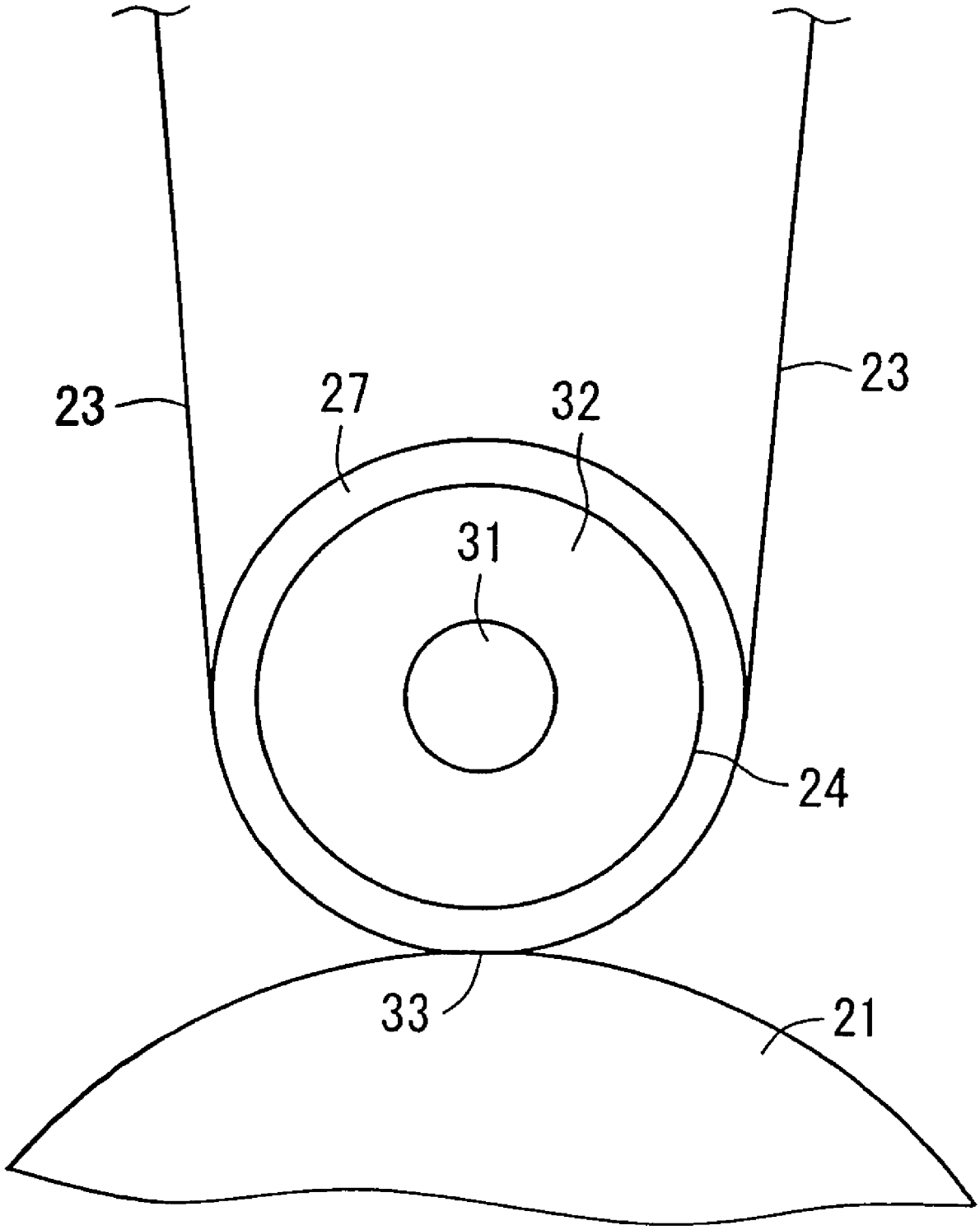
FIG. 2 is a magnified view of an area around a heating roller of the fixing apparatus of FIG. 1.

FIG. 1 is a simplified view illustrating the configuration of a fixing apparatus 20 according to a first embodiment of the invention, and FIG. 2 is a magnified view of an area around a heating roller 21 of the fixing apparatus 20 of FIG. 1.

The fixing apparatus 20 comprises a heating roller 21 and a pressure roller 22, a belt-shaped cleaning member 23, a press-contact roller 24, a feed-out roller 25, a wind-up roller 26 and an oil absorbing portion 27. The heating roller 21 and a pressure roller 22 are a pair of rotating bodies and form fixing rollers. The belt-shaped cleaning member 23 is disposed so as to abut on the heating roller 21 of the fixing rollers and cleans the surface of the heating roller 21. The cleaning member 23 is impregnated with oil in advance. The press-contact roller 24 is disposed so as to press the cleaning member 23 against the heating roller 21 on which the cleaning member 23 abuts. The feed-out roller 25 sends out the belt-shaped cleaning member 23 wound like a coil or a roll in advance. The wind-up roller 26 winds up the cleaning member 23 having been sent out from the feed-out roller 25 and having cleaned the surface of the heating roller 21. The oil absorbing portion 27 absorbs oil exudation out of the cleaning member 23.

The fixing apparatus 20 is provided with parts similar to those provided in a well-known fixing apparatus, such as a heater controlling power source that supplies electric power to a heater 28 serving as a heat source provided for the heating roller 21, a temperature sensor that detects the temperature of the heating roller 21, a pressing portion for pressing the pressure roller 22 against the heating roller 21, and a driving portion for driving the heating roller 21 and the pressure roller 22 to rotate, though these parts are not illustrated.

For example, the fixing apparatus 20 is installed in an electrophotographic image forming apparatus, and used for fixation, which is to make a recording medium with an image of an unfixed developer formed pass through a nip portion 29 formed by the heating roller 21 and the pressure roller 22, and thereby fuse and firmly adhere the unfixed developer onto the recording medium.

Of the parts configuring the fixing apparatus 20 described above, the cleaning member 23, the feed-out roller 25, the press-contact roller 24, the wind-up roller 26 and the oil absorbing portion 27 constitute a fixing roller cleaning unit 30 for eliminating and cleaning up a developer adhering to the surface of the fixing roller.

The cleaning member 23 is a long, belt-like member that can be wound up and rewound, and formed with such a material that has a structure allowing impregnation (absorption) of a fused developer adhering to the surface of the heating roller 21 into an air layer and/or air gap of a minute space, and that has heat resistance to a temperature of about 200° C. of a fixing temperature. For example, Nomex Paper (product name) or the like is favorable. The cleaning member 23 is impregnated with oil such as silicone oil in advance, for the purpose of increasing the heat resistance and the releasability of a developer as described before.

The press-contact roller 24 includes a roller core body 31, and a roller elastic portion 32 having a cylindrical shape that is disposed to the periphery of the roller core body 31. The roller core body 31 is a metallic member having a cylindrical shape, and is supported at both ends by an apparatus main body of the fixing apparatus 20 so as to freely rotate. The roller elastic portion 32 is formed with a foamed material heat-resistant in the present embodiment. For example, the foamed material having heat resistance is silicone rubber, urethane foam rubber and the like that are molded so as to contain air bubbles by making a foaming agent act at the time of solidification.

By elastic deformation of the roller elastic portion 32 when the press-contact roller 24 is pressed against the heating roller 21, a press-contact region 33 (this press-contact region will also be referred to as the nip portion 33 hereafter) is formed between the press-contact roller and the heating roller 21. The press-contact roller 24 is disposed so that the axis thereof becomes parallel to the axis of the heating roller 21, as well as so as to press the cleaning member 23 interposed between the press-contact roller and the heating roller 21 against the surface of the heating roller 21 by a pressing portion (not illustrated).

The oil absorbing portion 27 of the present embodiment is an oil absorbing layer 27 that is further disposed on the outer circumferential surface of the roller elastic portion 32 of the press-contact roller 24.

It is preferred that the oil absorbing layer 27 is made of an oil absorbing material which is absorbent of oil, and specifically, the oil absorbing layer is made of paper. It is preferred that the material of paper is pulp, but the material may be synthetic fiber or the like. Moreover, the material of the oil absorbing layer 27 is not limited to paper, and any substance can be used as far as the substance is a porous one having a minute space for absorbing the oil and can elastically deform. However, paper is the most preferable as the material of the oil absorbing layer 27, considering that paper has excellent oil absorbing ability and is easy to obtain, and moreover, can be recycled and reused after being deoiled.

Accordingly, the press-contact roller 24 presses the cleaning member 23 against the heating roller 21 via the oil absorbing layer 27, and the cleaning member 23 is situated between the heating roller 21 and the oil absorbing layer 27 to clean up a developer adhering to the surface of the heating roller 21. Although the oil impregnated into the cleaning member 23 in advance seeps through a fixing operation, the oil exudation is absorbed by the oil absorbing layer 27, and does not form an oil puddle on the outer circumferential surface of the heating roller 21. As a result, the fixing roller cleaning unit 30 can prevent contamination of the inside of the apparatus and a recording medium, and exert excellent cleaning performance.

The feed-out roller 25 is a reel-shaped member, around which a cleaning member 23*a* having a predetermined length is wound. The feed-out roller 25 is connected to a feed-out roller driving portion (not illustrated), and configured so as to be reversibly rotated, that is, rotated in both of normal and reverse directions by the feed-out roller driving portion, as well as so that a rotation speed can be controlled by the feed-out roller driving portion. The wind-up roller 26 is a reel-shaped member similar to the feed-out roller 25, and winds up the cleaning member 23 having been sent out from the feed-out roller 25 and having cleaned up a developer by being pressed against the heating roller 21 by the press-contact roller 24. The wind-up roller 26 is connected to a wind-up roller driving portion (not illustrated), and configured so as to be reversibly rotated, that is, rotated in both of normal and reverse directions by the wind-up roller driving portion, as well as so that a rotation speed can be controlled by the wind-up roller driving portion.

The operation of the fixing roller cleaning unit 30 will be briefly described below. The fixing roller cleaning unit causes the feed-out roller 25 to feed the cleaning member 23, makes the cleaning member pass through between the press-contact roller 24 and the heating roller 21, precisely, pass through the nip portion 33 formed by the oil absorbing layer 27 disposed to the periphery of the press-contact roller 24 and the heating roller 21, and causes the wind-up roller 26 to bite and wind up the tip portion of the cleaning member 23. By causing the feed-out roller 25 to manifest a brake function when causing the wind-up roller 26 to wind up the tip portion of the cleaning member 23, tension is applied to the cleaning member 23.

A wind-up operation of the wind-up roller 26 stops in a state where tension is applied to the cleaning member 23, and the surface of the heating roller 21 and the cleaning member 23 slidingly contact as the heating roller 21 performs a rotating operation in a state where the cleaning member 23 stands still, whereby the cleaning member 23 cleans the surface of the heating roller 21. After a certain amount of developer is cleaned up, the wind-up roller 26 executes the wind-up operation of winding up the cleaning member 23. That is to say, the wind-up roller 26 is driven to intermittently rotate. A distance in a circumferential direction that the wind-up roller 26 rotates and moves, that is, a movement distance of the cleaning member 23 on one wind-up occasion as the wind-up roller is driven to intermittently rotate, is set so as to be equal to or more than a distance in a circumferential direction of the nip portion 33 formed with the press-contact roller 24 pressed against the heating roller 21. Since it is possible to securely send an unused portion of the cleaning member 23 to the nip portion 33, by thus causing the wind-up roller 26 to wind up the cleaning member 23 so that the length thereof becomes equal to or more than at least the distance in the circumferential direction of the nip portion 33, it is possible to securely recover the cleaning performance of the cleaning member 23 in every wind-up operation.

A cleaning operation by the fixing roller cleaning unit 30 is, at the same time, a fixing operation by the work of the heating roller 21 and the pressure roller 22, and the cleaning member 23 is exposed to a temperature of about 200° C. of a fixing temperature through this operation, so that the oil gradually seeps out of the cleaning member 23 on the heating roller 21. However, since the fixing roller cleaning unit 30 has the oil absorbing layer 27 on the periphery of the press-contact roller 24, the oil exudation is successively absorbed by the oil absorbing layer 27, and does not form an oil puddle on the outer circumferential surface of the heating roller 21.

Besides, as the wind-up roller 26 is driven to intermittently rotate and winds up the cleaning member 23, the press-contact roller 24 is driven to rotate, that is, the oil absorbing layer 27 is driven to rotate to move a new absorbing surface to the nip portion 33. Therefore, it is possible to maintain the oil absorbency of the oil absorbing layer 27.

Figure 3:
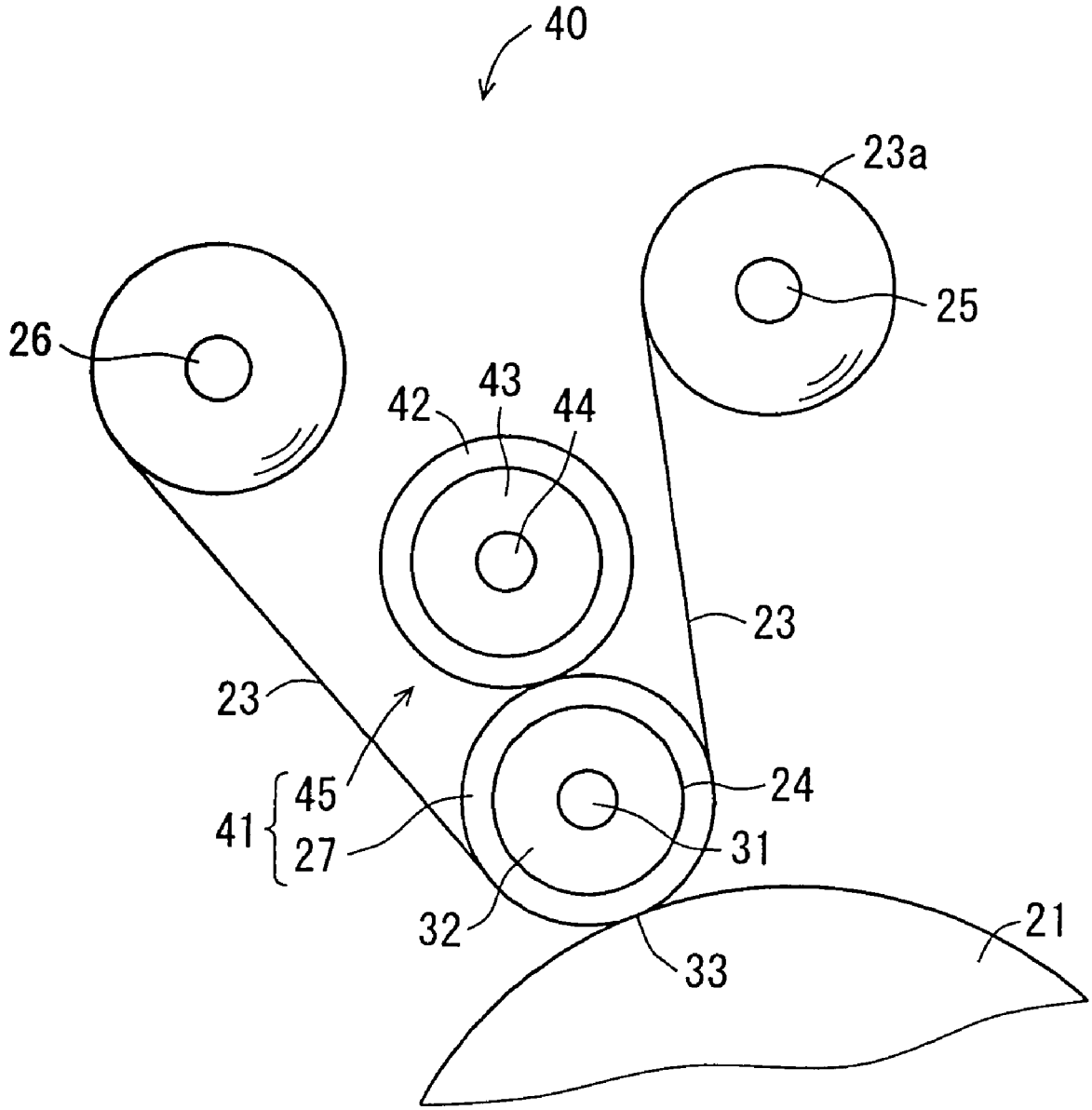
FIG. 3 is a simplified view illustrating the configuration of a fixing apparatus according to a second embodiment of the invention.

FIG. 3 is a simplified view illustrating the configuration of a fixing apparatus 40 according to a second embodiment of the invention. Since the fixing apparatus 40 of the present embodiment is similar to the fixing apparatus 20 of the first embodiment, corresponding parts will be denoted by the same reference numerals, and the descriptions thereof will be omitted. In FIG. 3, only a characteristic part of the fixing apparatus 40 is magnified and illustrated.

What should be noted on the fixing apparatus 40 is that oil absorbing portion 41 includes the oil absorbing layer 27 disposed on the outer circumferential surface of the press-contact roller 24, and an absorbing roller 45 that is disposed so as to abut on and back up the press-contact roller 24 and has an oil absorbing layer 42 on the outer circumferential surface thereof. For the sake of convenience, the oil absorbing layer 27 disposed to the press-contact roller 24 will be referred to as a first oil absorbing layer 27, and the oil absorbing layer 42 of the absorbing roller 45 will be referred to as a second oil absorbing layer 42.

The absorbing roller 45 includes an absorbing roller core body 44, an absorbing roller elastic portion 43 having a cylindrical shape that is disposed to the periphery of the absorbing roller core body 44, and the aforementioned second oil absorbing layer 42 disposed on the outer circumferential surface of the absorbing roller elastic portion 43. In the present embodiment, the configuration of the absorbing roller 45 is the same as that of the press-contact roller 24 and the first oil absorbing layer 27 disposed to the periphery thereof. That is to say, the absorbing roller core body 44 is a cylindrical member made of metal and is supported at both ends by the apparatus main body so as to freely rotate, the absorbing roller elastic portion 43 is made of a foamed material having heat resistance, and the second oil absorbing layer 42 is made of paper. The absorbing roller 45 is pressed against the press-contact roller 24 by pressing portion (not illustrated), and disposed as a back up roller for the press-contact roller 24. That is to say, the second oil absorbing layer 42 of the absorbing roller 45 is disposed so as to abut on the first oil absorbing layer 27 disposed to the press-contact roller 24.

Accordingly, the press-contact roller 24 is driven to rotate as the cleaning member 23 moves in accordance with an intermittent wind-up operation of the wind-up roller 26, and the absorbing roller 45 abutting on the press-contact roller 24 is further driven to rotate as the press-contact roller 24 rotates.

In the fixing apparatus 40 thus configured, the first oil absorbing layer 27 disposed to the press-contact roller 24 absorbs the oil exudation out of the cleaning member 23 and, when an oil absorbing portion of the first oil absorbing layer 27 reaches a part where the first oil absorbing layer 27 abuts on the second oil absorbing layer 42 as the press-contact roller 24 rotates, the second oil absorbing layer 42 can absorb the oil exudation via the first oil absorbing layer 27. As a result, it becomes possible to increase the amount of oil absorption, and it is possible to greatly decrease the frequency of replacement or maintenance of the oil absorbing portion 41 in the fixing apparatus 40.

Figure 4:
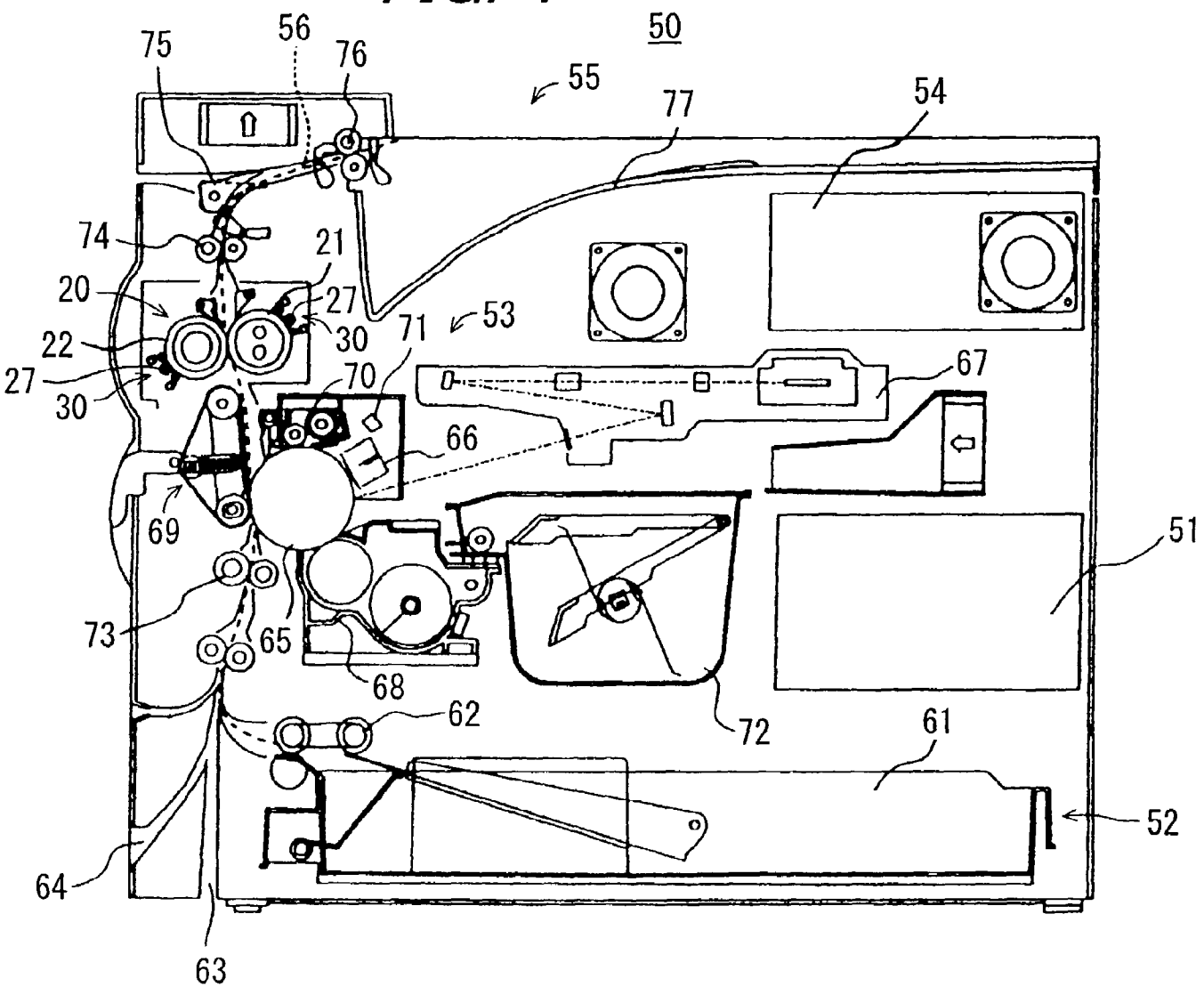
FIG. 4 is a simplified view illustrating the configuration of an image forming apparatus according to another embodiment of the invention.
Figure 5:
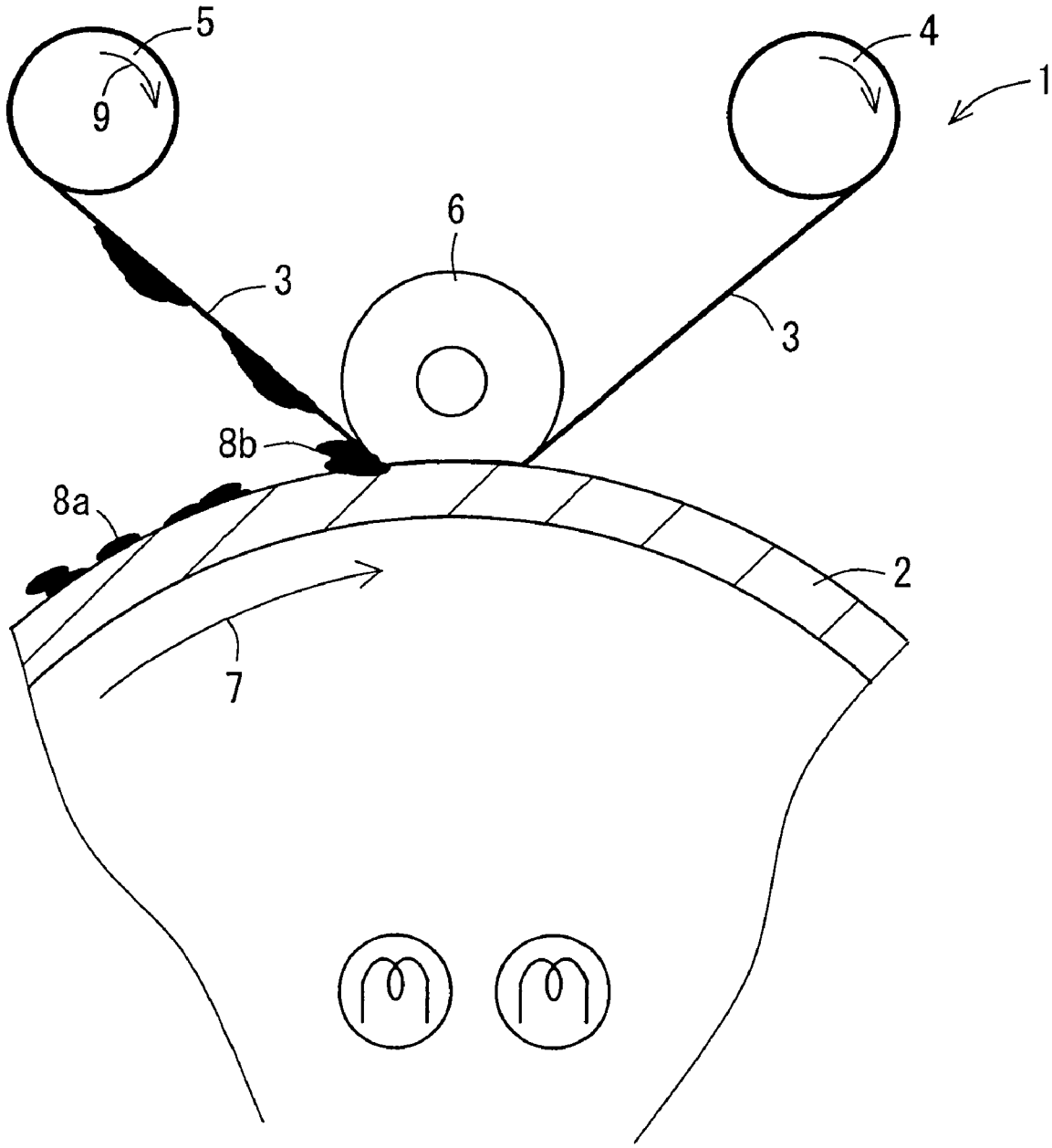
FIG. 5 PRIOR ART
FIG. 5 is a simplified view illustrating the configuration of the roller cleaning unit provided in the fixing apparatus of the related art.
Figure 6:
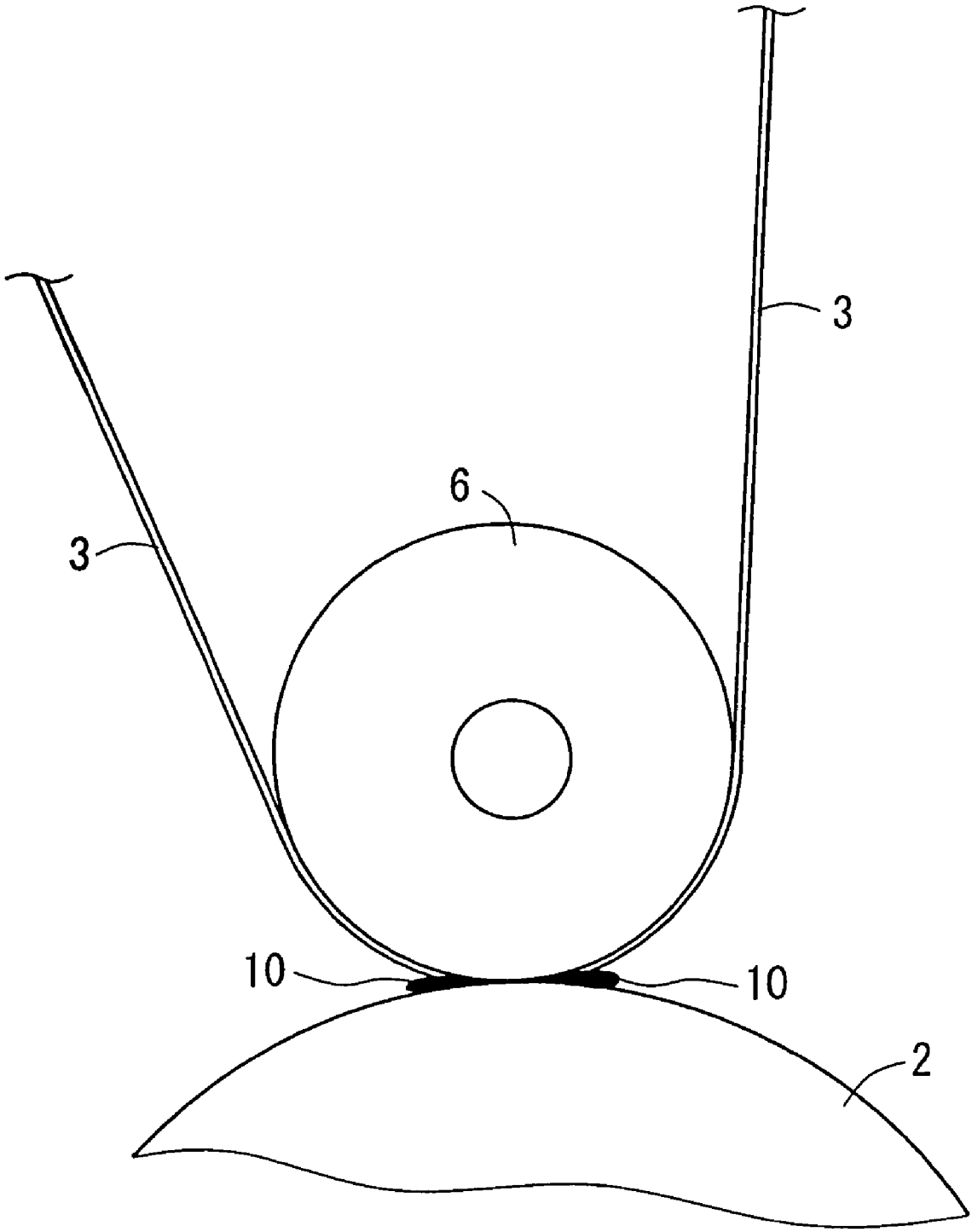
FIG. 6 PRIOR ART
FIG. 6 is a view illustrating a state where oil has seeped out of the cleaning member.

FIG. 4 is a simplified view illustrating the configuration of an image forming apparatus 50 according to another embodiment of the invention. The image forming apparatus 50 is equipped with the fixing apparatus 20 of the first embodiment described before. The image forming apparatus 50 illustrated as an example in the present embodiment is an electrophotographic printer.

In substance, the image forming apparatus 50 comprises a power source apparatus 51 that supplies electric power to every part of the image forming apparatus 50, a paper supplying portion 52 that supplies a recording sheet that is a recording medium to form and record an image, an image forming unit 53, the fixing apparatus 20, a control portion 54 that receives image information from external equipment and controls the operation of the whole image forming apparatus 50, a paper ejecting portion 55, and a paper conveying system 56 that conducts conveyance of a recording sheet from the paper supplying portion 52 to the paper ejecting portion 55.

The paper supplying portion 52 is provided with a supplying tray 61 that holds recording sheets, and a pickup roller 62 for sending out the recording sheets held by the supplying tray 61 to the paper conveying system 56 one by one. Below the paper supplying portion 52, as well as below an image forming apparatus main body, a paper supplying apparatus including a multistage paper tray, a large-capacity paper supplying apparatus that can hold a large number of sheets, and the like may be disposed as peripheral apparatuses. In a case where such peripheral apparatuses are disposed, recording sheets from the peripheral apparatus are supplied from a paper receiving portion 63 and an expanded paper receiving portion 64 to the image forming apparatus main body.

The image forming unit 53 is placed above the paper supplying portion 52, and includes a photoreceptor 65, a charging apparatus 66 disposed along the outer circumferential surface of the photoreceptor 65, a light scanning unit 67, a developing unit 68, a transfer apparatus 69, a photoreceptor cleaning unit 70, and a discharge lamp 71.

The charging apparatus 66 uniformly charges the surface of the photoreceptor 65 before being exposed by the light scanning unit 67. The light scanning unit 67 scans the uniformly charged photoreceptor 65 with light corresponding to image information to form an electrostatic latent image. The developing unit 68 supplies a developer contained in a developer supplying container 72 to the electrostatic latent image formed on the surface of the photoreceptor 65 to form a visualized developer image.

The transfer apparatus 69 transfers the developer image to a recording sheet supplied with the timing fixed so as to come to a developer image forming position on the photoreceptor 65 by a registration roller 73 disposed upstream from the photoreceptor 65 in the paper conveying system 56.

The photoreceptor cleaning unit 70 eliminates a residual developer that has not been transferred to the recording sheet and remains on the photoreceptor 65. The discharge lamp 71 eliminates charge from the surface of the photoreceptor 65 so as to get ready to be uniformly charged by the charging apparatus 66 next.

Downstream from the transfer apparatus 69 in the paper conveying system 56 is disposed the fixing apparatus 20, where the developer image transferred onto the recording sheet is fixed and a solid recording image is formed.

Downstream from the fixing apparatus 20 in the paper conveying system 56 are disposed a conveying roller 74 and a switching gate 75. The conveying roller 74 conveys the recording sheet having passed through the fixing apparatus 20 more downstream in the paper conveying system 56. The switching gate 75 selectively opens a conveying path on which the recording sheet conveyed by the conveying roller 74 should be conveyed. The paper ejecting portion 55 includes a paper ejecting roller 76 disposed downstream from the switching gate 75 in the paper conveying system 56, and a paper ejecting tray 77 on which recording sheets ejected outside the image forming apparatus main body by the paper ejecting roller 76.

For example, the control portion 54 is a processing circuit provided with a central processing unit (CPU), and is additionally provided with a memory serving as storing portion, an interface for receiving image information from external equipment, and so on. The control portion 54 controls the operation of the whole image forming apparatus 50, and the fixing apparatus 20 is also included in the objects of the control. In the memory of the control portion 54, a program for controlling the operation of the whole image forming apparatus 50 and the conditions of the operation control are stored in advance.

An image forming operation in the image forming apparatus 50 will be described below. Image information generated by external equipment such as a personal computer is given to the control portion 54 via the interface, and the image information is stored in the memory of the control portion 54. The control portion 54 reads out the image information from the memory to execute image processing such as conversion, and thereafter, sends the image information to the light scanning unit 67. The light scanning unit 67 exposes the surface of the photoreceptor 65 charged by the charging apparatus 66 to uniform potential, with light corresponding to the image information, thereby forming an electrostatic latent image.

The electrostatic latent image formed on the surface of the photoreceptor 65 is developed in the developing unit 68 to become a developer image. The transfer apparatus 69 transfers the developer image formed on the photoreceptor 65, onto a recording sheet supplied from the paper supplying portion 52 and sent in with the timing fixed by the registration roller 73. The recording sheet with the developer image transferred is subjected to fixation in the fixing apparatus 20, and thereafter, ejected to the paper ejecting tray 77 by the paper ejecting roller 76.

On the other hand, the photoreceptor 65 from which the developer image has been removed by the transfer apparatus 69 is cleaned by removing a residual developer on the surface of the photoreceptor 65 by means of the photoreceptor cleaning unit 70, and discharged by the discharge lamp 71. The image forming apparatus 50 is capable of repeatedly performing the image forming operation described above.

The fixing apparatus 20 installed in the image forming apparatus 50 operates so as to fix by fusing and softening a developer on a recording sheet. Since a developer adheres to the fixing roller due to repetition of the fixing operation to a plurality of recording sheets, the fixing roller is cleaned with the cleaning member 23 of the fixing roller cleaning unit 30 as described before. Moreover, when a certain amount of developer eliminated from the fixing roller is accumulated by cleaning in a gap between the cleaning member 23 and the fixing roller, the wind-up roller 26 is driven to rotate, the cleaning member 23 is wound up by a fixed length, and a clean portion of the cleaning member 23 is newly made to slidingly contact the fixing roller, whereby the cleaning ability of the cleaning member 23 is recovered to continue cleaning of the fixing roller.

Although the oil seeps out of the cleaning member 23 as described before through the operation of fixing an image formed by the image forming unit 53 of the image forming apparatus 50 in the fixing apparatus 20, the oil absorbing layer 27 disposed to the periphery of the press-contact roller 24 of the fixing apparatus 20 absorbs the oil exudation, with the result that it is prevented that the oil contaminates the inside of the apparatus, and it is avoided that a recording sheet is soiled with the oil. That is to say, according to the image forming apparatus 50 equipped with the fixing apparatus 20, it becomes possible to prevent deterioration of the image quality due to hot offset and prevent the oil from contaminating the inside of the apparatus and a recording sheet, even if the image forming operation is continued for a long term.

In the embodiments of the invention described above, the fixing roller cleaning unit 30 is disposed with respect to the heating roller 21, but may be disposed with respect to the pressure roller 22. Further, the fixing roller cleaning unit 30 may be disposed with respect to the heating roller 21 and pressure roller 22.

Further, in the embodiments of the invention described above, the image forming apparatus 50 is equipped with the fixing apparatus 20 according to the first embodiment of the invention, but may be equipped with the fixing apparatus 40 according to the second embodiment of the invention.

An example of the invention will be described below. In the example, the fixing apparatus 20 of the first embodiment of the invention, and the fixing apparatus 40 of the second embodiment were installed in image forming apparatus (Sharp Corporation AL-M236), respectively, and image formation was performed. An example in which the fixing apparatus 20 of the first embodiment was installed is an example 1, and an example in which the fixing apparatus 40 of the second embodiment was installed is an example 2. In a comparative example, a fixing apparatus without the oil absorbing portion was installed in the image forming apparatus, and image formation was performed.

Two hundred thousand (200 k) sheets of images were formed on A4 recording sheets prescribed by JIS-P0138 by each of the image forming apparatus of the examples 1, 2 and the comparative example, recording sheets with images formed were selected and visually observed at the moments of several sheets (initial), 1,000 (1 k) sheets, 10,000 (10 k) sheets, 50,000 (50 k) sheets, 100,000 (100 k) sheets and 200 k sheets, and the degree of soil with oil of an area around the tip portion in a conveyance direction of each of the recording sheets was assessed.

The basis for assessment of the soil with oil is as follows:

A: not soiled with oil

B: soiled with oil, but not conspicuous after drying

C: soiled with oil, and can be seen even after drying.

(Test 1)

In a test 1, the soil with oil in the case of continuously performing image formation of 200 k sheets was assessed. The result of the assessment is shown in Table 1.

TABLE 1

| | initial | 1k | 10k | 50k | 100k | 200k |
|---|---|---|---|---|---|---|
| Comparative example | A | A | B | C | C | C |
| Example 1 | A | A | A | A | B | B |
| Example 2 | A | A | A | A | A | A |

In the comparative example without the oil absorbing portion, the soil with oil was caused at the stage of 10 k sheets and, at the stage of 50 k sheets and more, the soil with oil remained even after drying and the quality was inferior. On the other hand, in the example 1 with the oil absorbing layer disposed to the press-contact roller, the soil with oil was not caused even at the stage of 50 k sheets and, at the stages of 100 k sheets and 200 k sheets, the soil with oil was caused but it became inconspicuous after drying. In the example 2 with the absorbing roller disposed in addition to the oil absorbing layer on the press-contact roller, the soil with oil was not caused at all and the assessment was extremely good even when image formation of 200 k sheets was finished.

(Test 2)

In a test 2, the soil with oil in the case of intermittently performing image formation was assessed, which is close to an actual working condition of the image forming apparatus. For example, by performing image formation of ten sheets and keeping the apparatus in a standby mode for ten minutes again and again, image formation of 200 k sheets was finished. The condition of the test 2 in which image formation was intermittently performed was hard to oil seepage out of the cleaning member, as compared with that of the test 1 in which image formation was continuously performed.

A fixing temperature decreases from a set temperature because recording sheets take heat when the recording sheets pass through the fixing apparatus as the image forming operation starts. On the other hand, the control portion returns the fixing temperature to the set value by increasing the amount of input electricity and counterbalancing the taken heat and the amount of input electricity, but time for performing image formation of a certain number of sheets is necessary to return. Therefore, in the case of performing image formation of a small number of sheets, for example, ten sheets or so, image formation is stopped and the apparatus goes into the standby mode before the counterbalance is achieved, so that the fixing temperature varies every time intermittent image formation is performed. When variation in fixing temperature gets large in this way, overshoot with respect to the set temperature also gets large, so that oil easily seeps out of the cleaning member. The result of the test executed under such an operating condition that was hard to oil seepage is shown in Table 2.

TABLE 2

| | initial | 1k | 10k | 50k | 100k | 200k |
|---|---|---|---|---|---|---|
| Comparison example | A | B | C | C | C | C |
| Example 1 | A | A | A | A | B | B |
| Example 2 | A | A | A | A | A | A |

Due to the hard operating condition, in the comparative example, the soil with oil remained even after drying and the quality was inferior at the moment of 10 k sheets, which was earlier than in the test 1. On the other hand, in the examples 1 and 2, regardless of the hard operating condition, the assessment was as good as in the test 1. In particular, in the example 2, the soil with oil was not caused at all even after image formation of 200 k sheets was finished, and the assessment was extremely good.

The results show that the image forming apparatus equipped with the fixing apparatus of the invention is capable of performing image formation for a long term without causing the soil with oil on recording sheets with images formed even under the actual working condition of intermittently performing image formation. Moreover, from the fact that recording sheets with images formed are not soiled with oil, it is possible to know that oil contamination is not caused in the apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing apparatus comprising:

fixing rollers composed of a pair of rotating bodies, that fuse an unfixed developer of an image which is formed on a recording medium and firmly adhere the unfixed developer onto the recording medium by passing the recording medium through a press-contact portion formed between the fixing rollers;

a belt-shaped cleaning member impregnated with oil in advance, for supplying the oil to at least one of the fixing rollers in contact therewith and cleaning a toner adhering to the at least one of the fixing rollers;

a press-contact roller disposed so that the cleaning member is pressed onto the at least one of the fixing rollers;

a feed-out roller for feeding the cleaning member that is belt-shaped and wound up in advance;

a wind-up roller for winding up the cleaning member fed by the feed-out roller and having cleaned the surface of the at least one of the fixing rollers; and an oil absorbing layer disposed on an outer circumferential surface of the press-contact roller, for absorbing oil exudation out of the cleaning member.

2. The fixing apparatus of claim 1, further comprising an absorbing roller that is disposed so as to abut on the press-contact roller and has a second oil absorbing layer.

3. The fixing apparatus of claim 2, wherein the first and second oil absorbing layers each include an oil absorbing material that is absorbent of oil.

4. The fixing apparatus of claim 3, wherein the oil absorbing material is paper.

5. The fixing apparatus of claim 1, wherein the oil absorbing layer includes an oil absorbing material that is absorbent of oil.

6. The fixing apparatus of claim 5, wherein the oil absorbing material is paper.

7. The fixing apparatus of claim 1, wherein the press-contact roller is made of a foamed material having heat resistance.

8. An image forming apparatus for forming a print image in electrophotographic system, comprising the fixing apparatus of claim 1.

9. A fixing roller cleaning unit provided in the fixing apparatus of claim 1, comprising:

a cleaning member that is belt-shaped, wound up and impregnated with oil in advance, for cleaning a surface of the at least one of the fixing rollers by abutting against the at least one of the fixing rollers;

a press-contact roller disposed so that the cleaning member is pressed onto the at least one of the fixing rollers;

a feed-out roller for feeding the cleaning member that is belt-shaped and wound up in advance;

a wind-up roller for winding up the cleaning member fed by the feed-out roller and having cleaned the surface of the at least one of the fixing rollers; and an oil absorbing portion for absorbing oil exudation out of the cleaning member.

* * * * *